US007452151B2

(12) United States Patent
Rousselet

(10) Patent No.: US 7,452,151 B2
(45) Date of Patent: Nov. 18, 2008

(54) DEVICE FOR PACKAGING AND APPLICATION OF A PRODUCT

(75) Inventor: Guilhem Rousselet, Saint Maur des Fosses (FR)

(73) Assignee: L'Oreal, Paris (FR)

( * ) Notice: Subject to any disclaimer, the term of this patent is extended or adjusted under 35 U.S.C. 154(b) by 516 days.

(21) Appl. No.: 11/174,475

(22) Filed: Jul. 6, 2005

(65) Prior Publication Data

US 2006/0008314 A1 Jan. 12, 2006

Related U.S. Application Data

(60) Provisional application No. 60/587,490, filed on Jul. 14, 2004.

(30) Foreign Application Priority Data

Jul. 6, 2004 (FR) ..... 04 51462

(51) Int. Cl.
*A46B 11/00* (2006.01)
*A46B 17/08* (2006.01)

(52) U.S. Cl. ..... 401/129; 401/122; 401/126

(58) Field of Classification Search ..... 401/130, 401/121, 122, 126, 127, 129
See application file for complete search history.

(56) References Cited

U.S. PATENT DOCUMENTS

| | | | | |
|---|---|---|---|---|
| 3,529,899 | A * | 9/1970 | Gruska | 401/121 |
| 4,761,088 | A | 8/1988 | Zubek | |
| 5,884,634 | A * | 3/1999 | Sheffler et al. | 132/218 |
| 5,888,005 | A * | 3/1999 | Gueret | 401/128 |
| 5,951,185 | A * | 9/1999 | Kingsford et al. | 401/99 |
| 6,375,374 | B2 * | 4/2002 | Gueret | 401/122 |
| 6,505,631 | B2 * | 1/2003 | Fischer et al. | 132/218 |
| 2002/0195117 | A1 * | 12/2002 | Bailly | 132/218 |

FOREIGN PATENT DOCUMENTS

| | | |
|---|---|---|
| DE | 196 42 720 A1 | 4/1998 |
| EP | 0 740 913 A1 | 11/1996 |
| EP | 1 066 771 A1 | 1/2001 |
| FR | 2 646 066 | 10/1990 |
| GB | 2 312 617 | 11/1997 |
| WO | WO 94/14357 | 7/1994 |

* cited by examiner

*Primary Examiner*—David J Walczak
(74) *Attorney, Agent, or Firm*—Oblon, Spivak, McClelland, Maier & Neustadt, P.C.

(57) ABSTRACT

A device for packaging and applying a product includes a container to hold the product, with this container having an opening at its upper end, a wiper element engaged at least partially in the opening, an applicator including an applicator element carried by a rod of axis X, and a closure element for the container. The wiper element includes a sealing zone against which part of the rod is capable of coming into leak-tight contact when the closure element is in the closed position, and a zone of greater deformability, located above the sealing zone, and which is capable of stretching axially when the rod is bearing against the sealing zone of the wiper element.

39 Claims, 2 Drawing Sheets

DEVICE FOR PACKAGING AND APPLICATION OF A PRODUCT

CROSS-REFERENCE TO RELATED APPLICATIONS

This document claims priority to French Application Number 04 51462, filed Jul. 6, 2004 and U.S. Provisional Application No. 60/587,490, filed Jul. 14, 2004, the entire content of which are hereby incorporated by reference.

FIELD OF THE INVENTION

The present invention relates to devices for packaging and applying a product. The invention can be particularly advantageous for packaging and applying cosmetic products, for example a mascara, a nail varnish or a liquid lip color.

The invention relates more particularly to a device including a container holding a product, an applicator incorporating an applicator element, a grasping element, a rod connecting the applicator element to the grasping element, and a wiper element arranged to at least partially wipe the applicator element when it is withdrawn from the container. The grasping element can additionally be in the form of a cap to ensure the closure of the device, for example, by screwing the cap onto the neck of the container.

BACKGROUND OF THE INVENTION

Discussion Of Background

To ensure leaktight closure of packaging/applicator devices it is known, by European patent application EP 0 740 913, international application WO 94/14357, U.S. Pat. No. 4,761,088 or patent application FR 2 646 066, to provide the wiper element with a collar against which the grasping element bears in an axial manner. With such arrangements, a portion of the grasping element or of the rod is squeezed axially against the collar.

Such devices can also be closed in a leaktight manner by a conical sealing system, using for example a rod incorporating a conical section bearing in a leaktight manner against a counterpart cone present in the upper internal part of the wiper element.

Given the manufacturing tolerances of the device, it is relatively difficult to ensure that the portion of the rod or grasping element bears in a leaktight manner against the wiper element exactly at the end of the screwing action of the cap, particularly when the seal is conical. It is in effect difficult to fit the two cones so that contact is not made too early, thereby precluding completion of the screwing action, or too late in which case there is no contact between the rod and the wiper element and therefore no seal is made. Mass production of such devices therefore calls for a high degree of precision which generates relatively high costs.

Moreover, when a conical seal is used, the product deposited by the applicator element on the wiper element, and therefore partly on the cone, is at least partially forced upwards when the sealing contact is made with the rod given that the contact surface is relatively large and extends as far as the upper end of the wiper element. After several successive uses, this deposit of product extends beyond the upper end of the wiper element, eventually fouling the screw thread on the neck of the container. It then becomes difficult or even impossible to screw the cap onto the neck of the container, thereby preventing closure of the container.

SUMMARY OF THE INVENTION

It is an object of the invention to provide a packaging and applicator device which avoids or reduces at least some and preferably all of the disadvantages of the prior art.

It is a particular object of the invention to provide a device which includes a reliable sealing system.

A further object of the invention is to provide a device that is simple to manufacture on an industrial scale.

According to the invention, these objects can be achieved by providing a device for packaging and applying a product including a container to hold the product. According to a preferred example, the container includes an opening at its upper end, a wiper element engaged at least partially in the opening, an applicator including an applicator element carried by a rod having an axis X, and a closure element provided for the container. The wiper element includes a sealing zone against which part of the rod is capable of coming into leaktight contact when the closure element is in the closed position, and a zone of greater deformability, located above the sealing zone, which is capable of stretching axially when the rod is bearing against the sealing zone of the wiper element. The zone of greater deformability is a zone of the wiper element which deforms more than other portions of the wiper element, for example, the rest of the wiper element located above the sealing zone.

When the closure element is in the closed position on the container, the zone of greater deformability can for example stretch by 50% of its length, measured along the axis of the rod. The zone of greater deformability of the wiper element enables the sealing zone on which the seal is made to be axially displaced, thereby imparting a wider degree of tolerance to the device. Development and production conditions can thus be facilitated, thereby facilitating industrial-scale manufacture of the device.

According to one preferred example, the wiper element can include a wiping zone formed at a distance from the sealing zone. In particular, by way of example, the sealing zone can be located at a sufficient distance from the wiping zone or wiper portion so that the wiping zone is not deformed when the rod is in leaktight contact against the sealing zone. In addition, the wiping function and the sealing function of the wiper element can thus be separated from each other.

The sealing zone can be formed at a distance from the upper end of the wiper element. As the rod comes into leaktight contact against a small surface formed at a distance from the upper end of the wiper element, the product remaining on the wiper element is not driven towards the outside of the container, and fouling of the outside of the container can thereby be avoided or reduced.

By way of example, the zone of greater deformability of the wiper element can have a lesser thickness than the rest of the wiper element located above the sealing zone. The zone of greater deformability of the wiper element has, for example, a thickness less than 1 mm and preferably less than 0.6 mm.

Alternatively or in addition, the zone of greater deformability can be made of a material different from the material constituting the rest of the wiper element, with the material of the zone of greater deformability having greater deformability than the material constituting the rest of the wiper element.

Also by way of example, the sealing zone of the wiper element can be delineated by a shoulder. The shoulder can extend radially towards the inside of the wiper element, delineating an annular surface perpendicular to the axis X of the rod. As a variant, the shoulder can delineate a conical surface converging towards the opening of the container. Such a shape serves to compensate any deformation of the shoulder of the wiper element when the rod exerts a force directed towards the lower end of the wiper element.

The rod can also include, for example, a shoulder intended to bear against the sealing zone of the wiper element.

The container can include a neck in which the wiper element is at least partially engaged.

The wiper element can be made, for example, of an elastomer material or a polyolefin, in particular polyethylene. Also by way of example, the wiping zone can define a circular aperture having a diameter adapted to that of the rod to be wiped. However, other shapes could also be defined by the aperture of the wiping zone. The diameter of the aperture defined by the wiping zone in an undeformed state can be less than or equal to the diameter of the portion of rod in contact therewith when the device is closed.

According to a preferred example, the wiping zone can be a lip, and the applicator element can be a brush, a comb or can incorporate a foam tip. The container can hold a cosmetic product, such as a mascara. However, the invention could also be advantageously used for other cosmetic products such as a nail product or a liquid lip color.

As should be apparent, the invention can provide a number of advantageous features and benefits. It is to be understood that, in practicing the invention, an embodiment can be constructed to include one or more features or benefits of embodiments disclosed herein but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

In addition to the description above, the invention will be further understood from the description below, in relation to non-limiting embodiments or example, described in conjunction with the attached figures wherein.

DETAILED DESCRIPTION OF THE PREFERRED EMBODIMENTS

Figure 1:
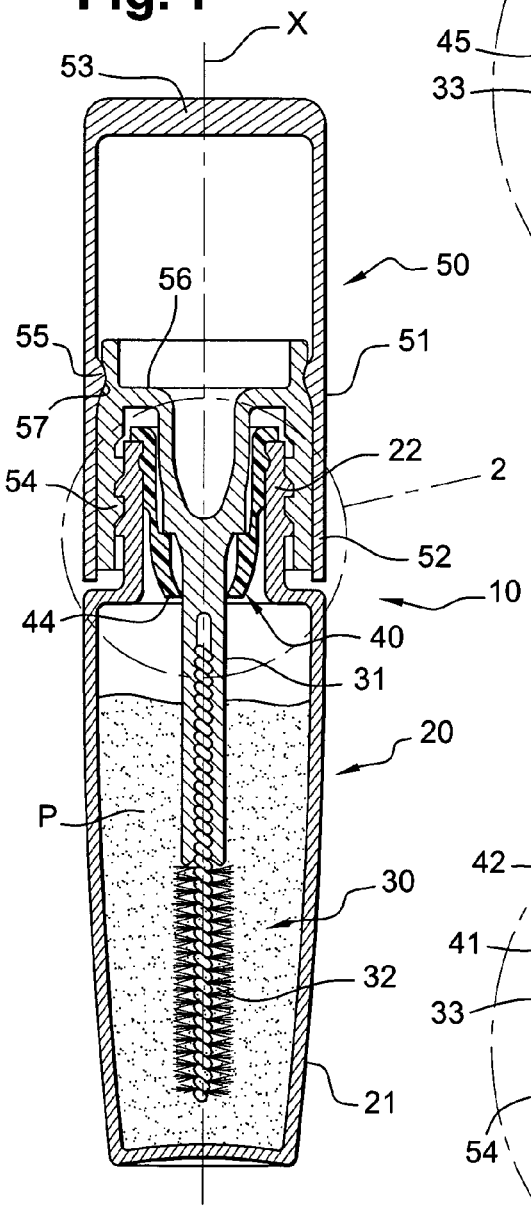
FIG. 1 is a diagrammatic view in axial cross section of a packaging and applicator device according to one embodiment of the invention.

FIG. 1 depicts a device 10 for packaging and applying a product P, for example a cosmetic product such as mascara.

This device 10 includes a container 20, for example of elongated shape, an applicator 30 and a wiper element 40 permanently fixed on the container 20.

The container 20 includes a body 21 containing the product fitted, in the upper part in the example considered, with a neck 22. The neck 22 is threaded externally in the example illustrated. The upper end of the neck defines an opening in which the wiper element 40 is engaged in this example.

The applicator 30 includes a rod 31 having an axis X, of circular cross-section over substantially its full length in the example considered. The applicator 30 is fitted at its lower end with an applicator element 32 in the form of a twisted-core brush in the example illustrated.

The rod 31 is connected at its upper end to a grasping element 50 which can also provide a closure element for the container 20.

The closure element includes an external cap 51 formed by a cylindrical wall 52 connected at the top to a transverse wall 53 perpendicular to the axis X. A tubular skirt 54, made in one piece with the rod 31 in the example illustrated, is fitted inside the cap in which it is held by retaining means incorporating for example a projection such as an annular bead 55 arranged to sit in a counterpart groove 57 on the skirt 54. The tubular skirt 54 and the rod 31 are connected together by an annular wall 56 extending transversely relative to the axis X.

The tubular skirt 54 is threaded on its inner surface to facilitate screwing of the closure element onto the neck of the container. The skirt 54 and neck 22 preferably additionally include a projection, not shown, below their respective screw threads. The two projections are intended to engage with each other to mark the end of the screwing action. In particular, by way of example, the projection provided on the skirt is intended to come into contact with the projection provided on the neck as the cap is screwed onto the container and to pass over it by deforming resiliently so as to produce an audible signal at the end of the screwing action.

Figure 2A:
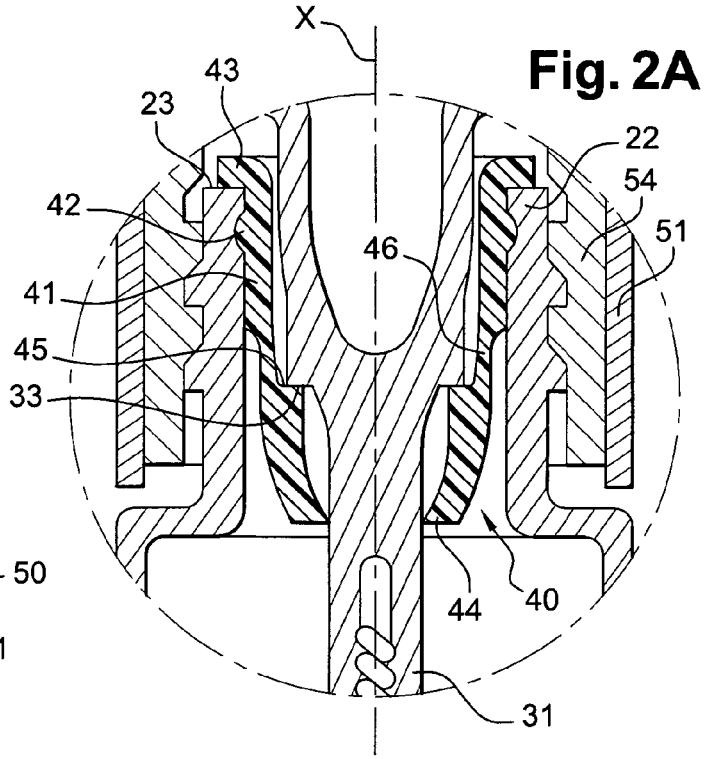
FIGS. 2A and 2B are enlarged diagrammatic views of detail 2 in FIG. 1, respectively in the closed position and in the process of opening.
Figure 2B:
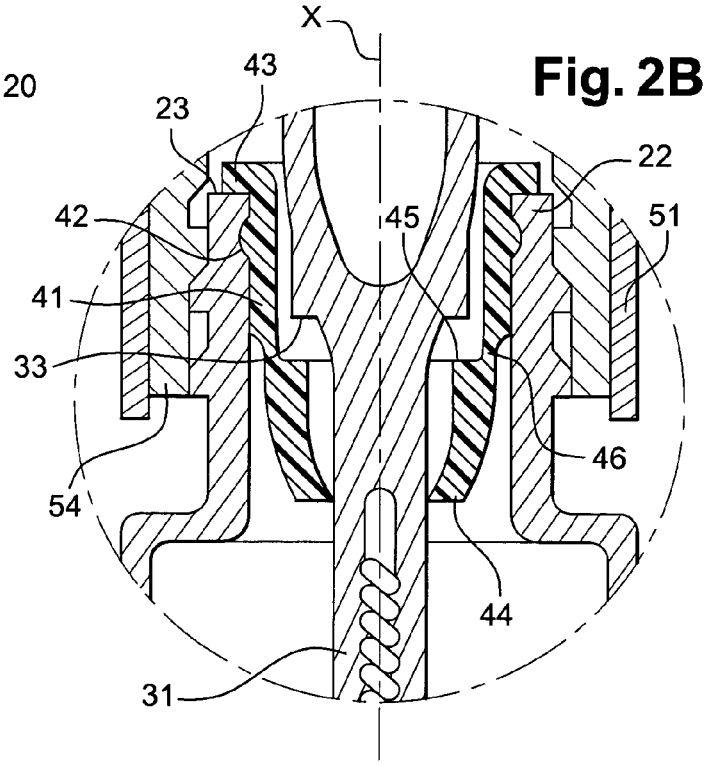
Figure 3:
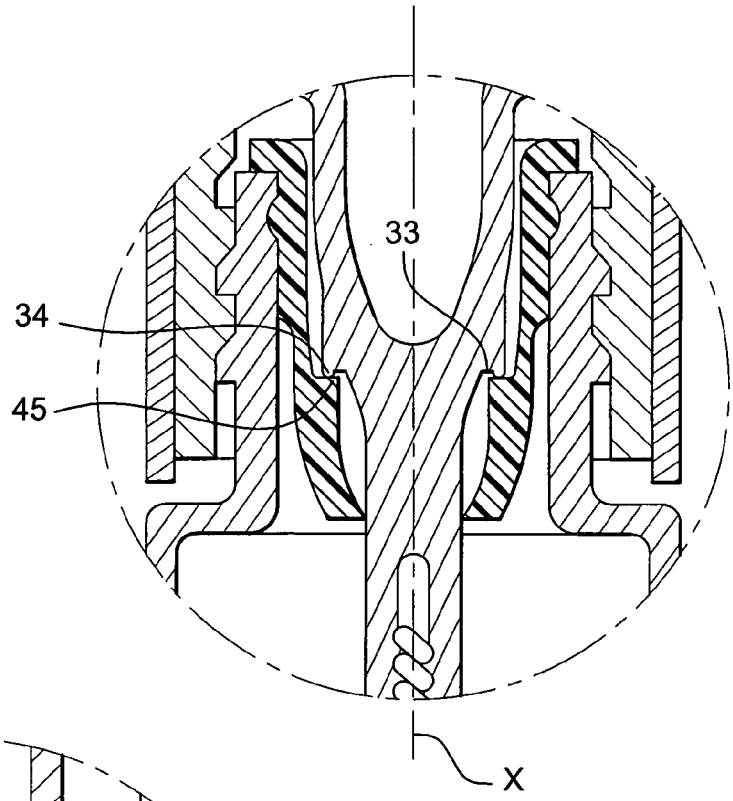
FIGS. 3 and 4 are partial illustrations of alternative embodiments of the invention.

Referring now to FIGS. 2 and 3, it can be seen that the wiper element 40 includes a body 41 applied against the inner surface of the neck 22. This body 41 can include an arrangement or structure for retention on the container 20. This retaining arrangement can include, for example as illustrated, a projection such as an annular bead 42 arranged to sit in a counterpart groove on the inner surface of the neck 22.

In the upper part, the wiper element 40 includes a collar 43 bearing on the upper end 23 of the neck 22. The wiper element 40 includes at its lower part an annular wiping lip 44, defining an aperture of circular cross-section for example, with this lip 44 being arranged to be applied against the rod 31 and/or the applicator element 32 as the applicator 30 is withdrawn from the container. In particular, and by way of example, the lip 44 defines a circular aperture having a diameter substantially equal to that of the portion of the rod with which it is in contact when the device is closed. As also shown in the illustrated example, the innermost diameter of the lip of the wiper portion or wiping zone is smaller than the innermost diameter of the sealing zone.

The wiper element 40 can be made for example of an elastomer material or a polyolefin, in particular polyethylene or any other plastic. In the example illustrated, the wiper element 40 is made of a single material.

To ensure leaktight closure of the container, when the device 10 is closed, the rod is arranged to bear in a leaktight manner against the wiper element.

To this end, the rod includes an annular shoulder 33 intended to bear on an annular shoulder 45 formed in the wiper element when the closure element is screwed onto the container. The shoulder 33 formed in the rod delineates an annular surface, facing towards the brush 32, which extends in a plane perpendicular to the axis X of the rod. The shoulder 45 formed in the wiper element also delineates an annular surface, facing towards the upper end of the wiper element, which also extends in a plane perpendicular to the axis X of the rod.

Figure 4:
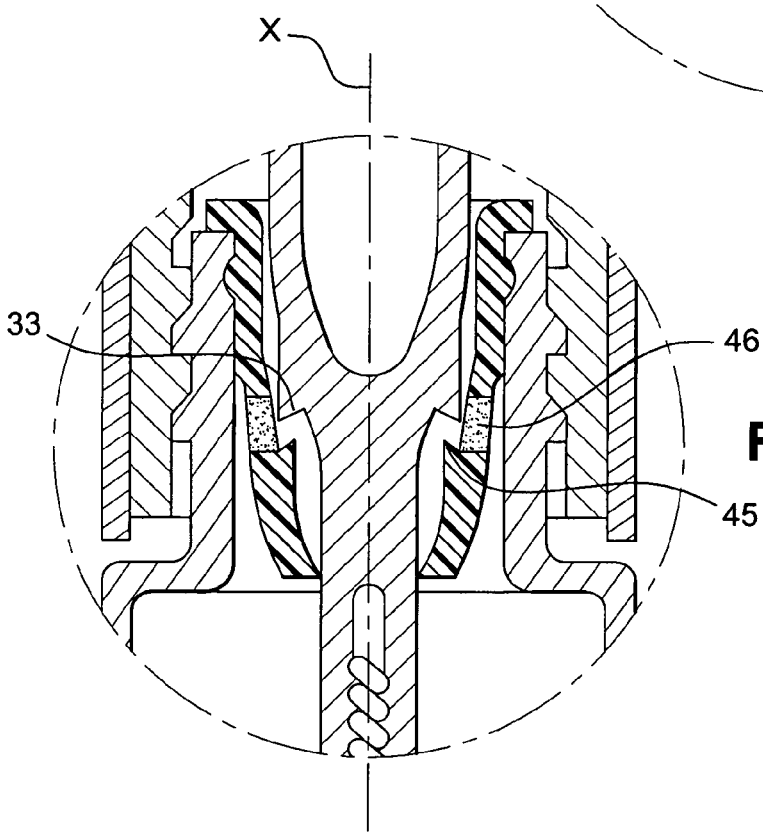

According to a variant illustrated in FIG. 4, the shoulders 33 and 45 define a conical surface which converges towards the axis X, rather than an annular surface perpendicular to axis X.

To further improve the leaktight contact between the rod and the wiper element, provision can additionally be made for a boss or protrusion 34 on the shoulder 33 of the rod, as illustrated in FIG. 3. The boss or protrusion 34 is intended to substantially compress the shoulder 45 of the wiper element. Thus, with the FIG. 3 example, the shoulder of the rod can provide a radial protrusion, while the boss can provide an axial protrusion which contacts the shoulder of the wiper element. With the FIG. 4 arrangement with the conical shoulder on rod, the shoulder also protrudes radially and axially, and in addition, the conical shoulder of the wiper element protrudes radially and axially (with the axial protrusion in a direction opposite to that of the shoulder of the rod).

The contact between the two shoulders 33 and 45 ensures leaktight closure of the device when the applicator is in the stowed position on the container. The product can then be better preserved inside the container. In addition, as the rod comes into leaktight contact against an annular surface formed substantially perpendicular to the axis of the rod or in an oblique manner, practically none of the product remaining on the wiper element will be pushed to the upper end of the wiper element at the moment when leaktight contact is made. Furthermore, even if some product is pushed towards the upper end of the wiper element, it is not driven to the outside of the container as the leaktight contact is made at a distance from the upper end of the wiper element.

To ensure that the two shoulders effectively bear against each other in a leaktight manner at the end of the screwing action, in particular just after the audible signal, the wiper element 40 advantageously and preferably includes a deformable zone 46 which can stretch on the axis of the rod so as to substantially vary the axial position of the zone where the seal is formed. The relative position of the shoulders can thus be determined with a wider tolerance. In particular, provision can be made for the two shoulders to come into contact with each other substantially before the end of the screwing action of the closure element. Once the shoulders are in contact with each other, screwing of the closure element is still possible by virtue of stretching of the deformable zone of the wiper element which enables the rod to move the shoulder 45 of the wiper element downward.

In the example illustrated in FIGS. 1, 2A and 2B, the deformable zone 46 is composed of a wall of lesser thickness, located above the shoulder 45. When the closure element is screwed onto the container, the wall 46 is stretched in an axial direction, along the axis of the rod, as illustrated in FIG. 2A. When the closure element is unscrewed, the wall 46 retracts, as illustrated in FIG. 2B.

According to a particular example, the wall 46 has a thickness of 0.4 mm, while the body 41 of the wiper element has a wall thickness of 1.2 mm and the wall thickness of the wiper element at the shoulder 45 is approximately equal to 1.5 mm. When it is not stretched, in particular when the closure element is unscrewed, the wall 46 has a length for example, measured on axis X, approximately equal to 2 mm. When the closure element is screwed on, the stretched wall 46 has a length approximately equal to 3 mm.

As a variant, the deformable zone of the wiper element can be composed of a wall, having the same thickness as the rest of the wiper element but made of a more deformable material than that of which the rest of the wiper element is made, as illustrated at 46 in FIG. 4. The deformable zone can for example be made with a thermoplastic elastomer, in particular PP/SBS, PP/SEBS, very low density polyethylene such as metallocenes, a PET elastomer such as Arnitel®, or NBR. In another variant, provision can also be made for the deformable zone to be composed of a wall of lesser thickness and of a material different from the rest of the wiper element. As should be recognized, different variations are possible.

The deformable zone of the wiper element can also include, for example, reinforcing elements on its outer wall intended to prevent any deformation other than on the axis X of the deformable zone. Provision can be made for example for longitudinal ribs extending parallel to the axis X to prevent the deformable zone from curling but which allow it to stretch.

Figure 5:
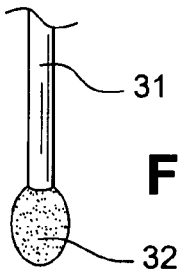
FIGS. 5 and 6 are diagrammatic illustrations of other applicator elements.
Figure 6:
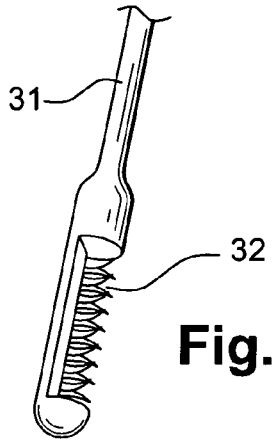

The applicator element 32 can have a form other than a brush, and in particular, as illustrated in FIG. 5, by a tip which may or may not be covered in flock material or foam or, as illustrated in FIG. 6, by a comb. The applicator element can for example be made in one piece by molding with the rod and the grasping element, for example, to form a comb type element.

Of course, the invention is not limited to the examples described above. It is possible for example to envisage a variety of other shapes for the container or the grasping element.

Attachment of the applicator to the container can also be achieved by means other than screwing. For example, closure of the device can be obtained by snapping the grasping element onto the neck of the container, with the inner surface of the tubular skirt having an annular groove and the neck a corresponding bead. Nor is the scope of the present invention exceeded if the applicator includes an applicator element different from those just described, for example a pencil brush.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for packaging and applying a product including:

a container which can hold the product, the container including an opening at its upper end;

a wiper element at least partially engaged in the opening;

an applicator including an applicator element carried by a rod; and a closure element for the container;

wherein the wiper element includes:

a sealing zone against which part of the rod comes into leaktight contact when the closure element is in a closed position; and a zone of greater deformability, located above the sealing zone, which is capable of stretching axially when the rod bears against the sealing zone of the wiper element;

wherein the sealing zone of the wiper element is delineated by a shoulder; and wherein the shoulder delineates a conical surface converging towards the opening of the container.

2. The device according to claim 1, wherein the wiper element includes a wiping zone located at a distance spaced from the sealing zone.

3. The device according to claim 2, wherein the wiping zone defines a circular aperture having a diameter adapted to that of the rod to be wiped.

4. The device according to claim 3, wherein the diameter of the aperture defined by the wiping zone in an undeformed state is less than or equal to the diameter of the portion of the rod in contact therewith when the device is closed.

5. The device according to claim 2, wherein the wiping zone is a lip.

6. The device according to claim 2, wherein the sealing zone is positioned axially between the zone of greater deformation and the wiping zone.

7. The device according to claim 2, wherein the sealing zone is located at a distance spaced from the upper end of the wiper element.

8. The device according to claim 1, wherein the zone of greater deformability of the wiper element has a smaller thickness than the rest of the wiper element located above the sealing zone.

9. The device according to claim 8, wherein the zone of greater deformability of the wiper element includes a wall thickness less than 1 mm.

10. The device according to claim 9, wherein the zone of greater deformability includes a wall thickness of less than 0.6 mm.

11. The device according to claim 8, wherein the zone of greater deformability is made of a material different from a material of the rest of the wiper element, wherein the material of the zone of greater deformability has greater deformability than the material of the rest of the wiper element.

12. The device according to claim 1, wherein the zone of greater deformability is made of a material different from a material of the rest of the wiper element, wherein the material of the zone of greater deformability has greater deformability than the material of the rest of the wiper element.

13. The device according to claim 1, wherein the rod includes a shoulder which bears against the sealing zone of the wiper element when the closure element is in the closed position.

14. The device according to claim 1, wherein the shoulder extends radially on the inside of the wiper element and delineates an annular surface perpendicular to an axis X of the rod.

15. The device according to claim 1, wherein the container includes a neck forming the opening and in which the wiper element is at least partially engaged.

16. The device according to claim 1, wherein the wiper element is made of an elastomer material.

17. The device according to claim 1, wherein the wiper element includes a polyolefin material.

18. The device according to claim 1, wherein the wiper element includes a polyethylene material.

19. The device according to claim 1, wherein the applicator element is a brush.

20. The device according to claim 1, wherein the applicator element is a comb.

21. The device according to claim 1, wherein the applicator element includes a foam tip.

22. The device according to claim 1, wherein the container contains a cosmetic product.

23. The device according to claim 1, wherein the container contains a mascara.

24. The device according to claim 1, wherein the applicator is coupled to the closure element.

25. The device according to claim 1, wherein when the closure element is in the closed position said part of said rod is in contact with said sealing zone and a force of said rod against said sealing zone causes axial deformation of said zone of greater deformability; and wherein upon removal of said applicator from said container said part of said rod is moved out of contact from said sealing zone and thereafter the applicator element is wiped by said wiper element.

26. The device according to claim 25, wherein the wiper element includes a wiping zone which wipes the applicator element, and wherein said sealing zone of said wiper element is positioned axially between the wiping zone and the zone of greater deformability.

27. The device according to claim 26, wherein said part of said rod which contacts said sealing zone includes at least one protrusion.

28. The device according to claim 27, wherein said at least one protrusion protrudes both in a radial direction and in an axial direction.

29. The device according to claim 27, wherein said at least one protrusion includes a shoulder having a portion which projects in an axial direction and wherein said portion contacts said sealing zone in the closed position.

30. The device according to claim 27, wherein the zone of greater deformability has a wall thickness smaller than a wall thickness of other portions of said wiper element above the zone of greater deformability.

31. The device according to claim 26, wherein said part of said rod which contacts said sealing zone includes at least one protrusion.

32. The device according to claim 1, wherein said part of said rod includes a shoulder which protrudes radially outwardly from said rod.

33. The device according to claim 32, wherein said shoulder of said rod also includes a portion which protrudes in an axial direction.

34. The device according to claim 33, wherein said shoulder of said sealing zone of said wiper element also protrudes in an axial direction opposite to the axial direction which the shoulder of said rod protrudes.

35. A device for packaging and applying a product including:

a container which can hold the product, the container including an opening at its upper end;

a wiper element at least partially engaged in the opening;

an applicator including an applicator element carried by a rod; and a closure element for the container;

wherein the wiper element includes:

a sealing zone against which part of the rod comes into leaktight contact when the closure element is in a closed position; and a zone of greater deformability, located above the sealing zone, which is capable of stretching axially when the rod bears against the sealing zone of the wiper element;

wherein said sealing zone includes a shoulder which protrudes radially inwardly from an inside of said wiper element and said part of said rod includes a shoulder which protrudes radially outwardly from said rod;

wherein said shoulder of said rod also includes a portion which protrudes in an axial direction;

wherein said shoulder of said sealing zone of said wiper element also protrudes in an axial direction opposite to the axial direction which the shoulder of said rod protrudes; and wherein the shoulder of the rod forms a section of a cone and the shoulder of the sealing zone forms a section of a cone.

36. The device according to claim 1, wherein the wiper includes a wiper portion which wipes said application element, and further wherein the wiper portion is positioned below said sealing zone.

37. The device according to claim 36, wherein the wiper portion has an inner diameter smaller than an inner diameter of said radially inwardly projecting shoulder of said sealing zone.

38. The device according to claim 36, wherein the zone of greater deformability is made of a different material than said wiper portion.

39. The device according to claim 1, wherein the zone of greater deformability is formed of a different material than the rest of the wiper element, and wherein the sealing zone is adjacent the zone of greater deformability.

* * * * *